US005323762A

United States Patent [19]

Chiang et al.

[11] Patent Number: 5,323,762

[45] Date of Patent: Jun. 28, 1994

[54] AUTOMATIC CLEANING DEVICE OF SMOKE EXHAUSTER

[76] Inventors: Chao C. Chiang; Chi H. Chiang, both of 13, 2 Alley, 311 Lane, 2 Sec., Chung Shan Rd., Tai Peiping, Taichung, Taiwan

[21] Appl. No.: 959,398

[22] Filed: Oct. 13, 1992

[51] Int. Cl.[5] ..... F23J 11/00; F23J 3/02

[52] U.S. Cl. ..... 126/299 E; 415/121.3

[58] Field of Search ..... 126/299 E; 134/172, 134/180, 181; 415/117, 121.3, 203, 206

[56] References Cited

U.S. PATENT DOCUMENTS

| | | | |
|---|---|---|---|
| 793,204 | 6/1905 | Lemke | 415/121.3 X |
| 3,106,334 | 10/1963 | Fugleman et al. | 415/121.3 X |
| 3,170,646 | 2/1965 | Springer | 415/121.3 X |
| 3,795,181 | 3/1974 | Lawson | 126/299 E |

*Primary Examiner*—Harold Joyce

[57] ABSTRACT

An automatic cleaning device of a smoke exhauster comprises a fluid emitting pump provided with a pump body of hollow construction and with a revolving rod having an upper end fastened to a spindle of a motor of the smoke exhauster and further having a lower end fastened with a spiral body located in the interior of the pump body, which is provided at the top wall thereof with a plurality of fluid emitting tubes communicating with the interior of the pump body and at the bottom wall thereof with a plurality of fluid admitting tubes in communication with the interior of the pump body. A cleaning fluid reservoir of basinlike construction is detachably mounted under an air inlet of the smoke exhauster. The cleaning fluid in the reservoir is drawn into the pump body via the fluid admitting tubes and is then emitted via the fluid emitting tubes by the rotating action of the spiral body of the pump body.

2 Claims, 2 Drawing Sheets

AUTOMATIC CLEANING DEVICE OF SMOKE EXHAUSTER

BACKGROUND OF THE INVENTION

This invention relates to the auto-cleaning device of smoke-exhausting machine in kitchen.

The conventional smoke-exhausting machine in kitchen will accumulate smoke soot easily, and then become bad looking and hard to be cleaned. The most common way to clean the machine is manual cleaning, that seems to be inconvenient and take much time, and will result in environment contamination on cleaning. Thus we are trying to get the auto-cleaning device for smoke-exhausting machine in kitchen to improve the situation.

SUMMARY OF THE INVENTION

The primary object of this invention is to provide the auto-cleaning device of smoke-exhausting machine in kitchen which includes a set of spraying pump, detergent supplying tube, detergent spraying tube, and detergent basin, and will clean the blower of the machine automatically and conveniently without contaminating the environment.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
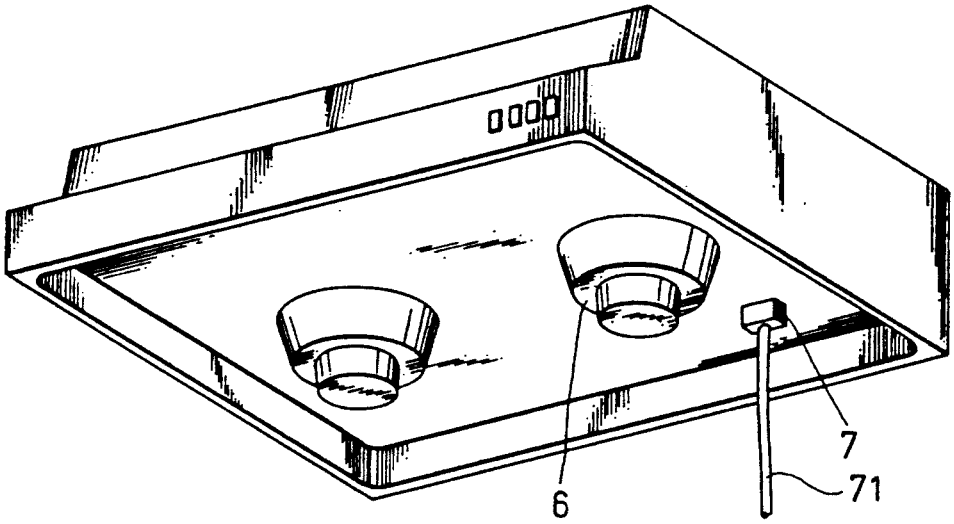
FIG. 1 is a perspective view of smoke-exhausting machine in kitchen with auto-cleaning device.
Figure 2:
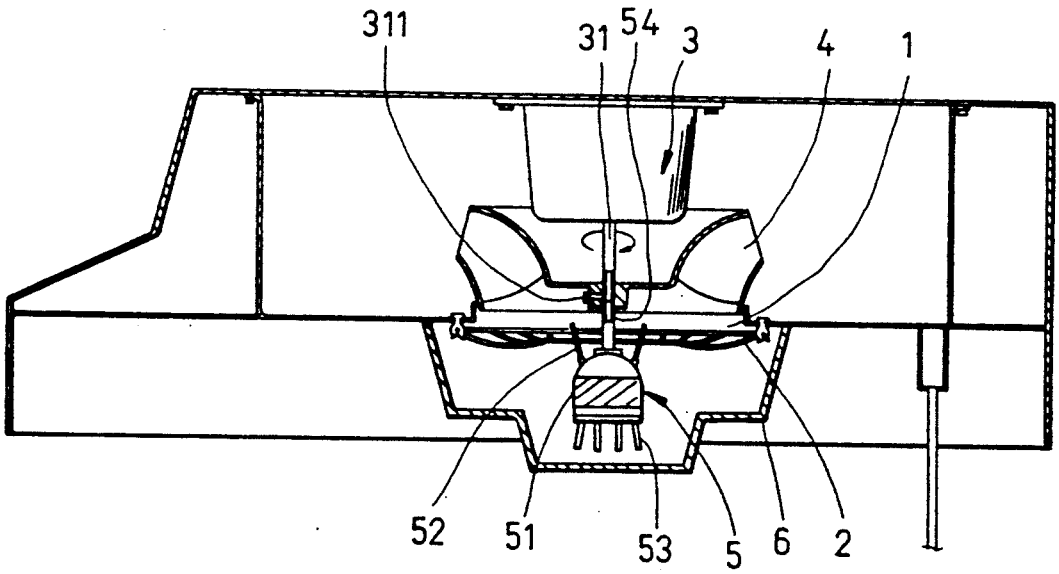
FIG. 2 is the side cross section view of the auto-cleaning device in smoke-exhausting machine in kitchen.

Referring to FIG. 1 and FIG. 2 the preferred embodiment of auto-cleaning device of smoke-exhausting machine in kitchen in accordance with this invention comprises the spraying pump 5, detergent supplying tube 53, detergent spraying tube 52, and detergent basin 6. Almost all parts of the device are installed in the downwards side of air inlet 1 of the machine. Nearby the air inlet 1 there are metal protection web 2 at the bottom of air inlet 1, and blower 4 jointed with the axle 31 of motor 3. The spraying pump 5 is fixed under the blower 4 and protection web 2 by screwing 311 onto both the extending axle 31 of blower 4 and rotating rod 54 of spraying pump 5.

Figure 3:
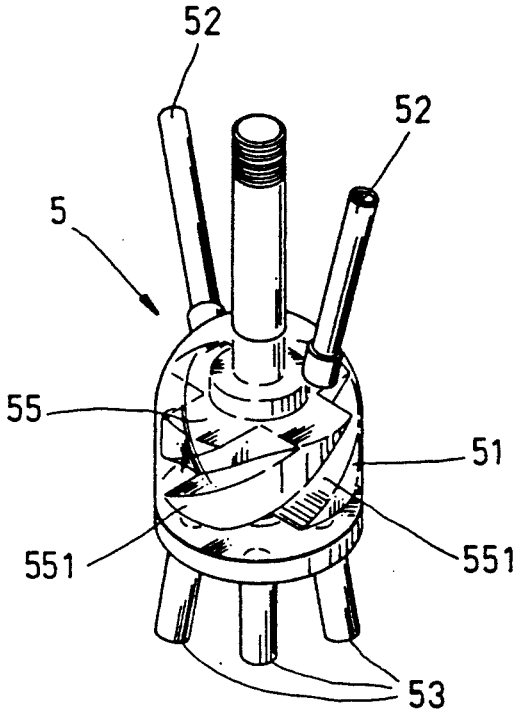
FIG. 3 is the perspective view of spraying pump of the auto-cleaning device.

Referring to FIG. 3 the middle part of spraying pump 5 is a cylindrical body 51 with some empty space inside There are detergent supplying tubes 53 at the bottom side and detergent spraying tubes 52 at the top side of the cylindrical body 51, and all tubes are directed into inside empty space of the cylindrical body 51. In the top portion of the cylindrical body 51 a rotating rod 54 is jointed with spiral body 55 inside the cylindrical body 51. The spiral body 55 is composed of spiral edges 551 which go up in the direction of motor 3 axle 31 rotation. While the spiral body 55 rotates in the predetermined direction, these spiral edges 551 will lift up the liquid (detergent) inside this cylindrical body 51 and then spray out the liquid (detergent) through spraying tube 52. The detergent basin 6 is the detachable cover at the end of air inlet 1, which is a step down type shaped as basin so that the detergent can be put into and detergent supplying tube 53 will be submerged into the detergent in the bottom portion of the basin 6.

Figure 4:
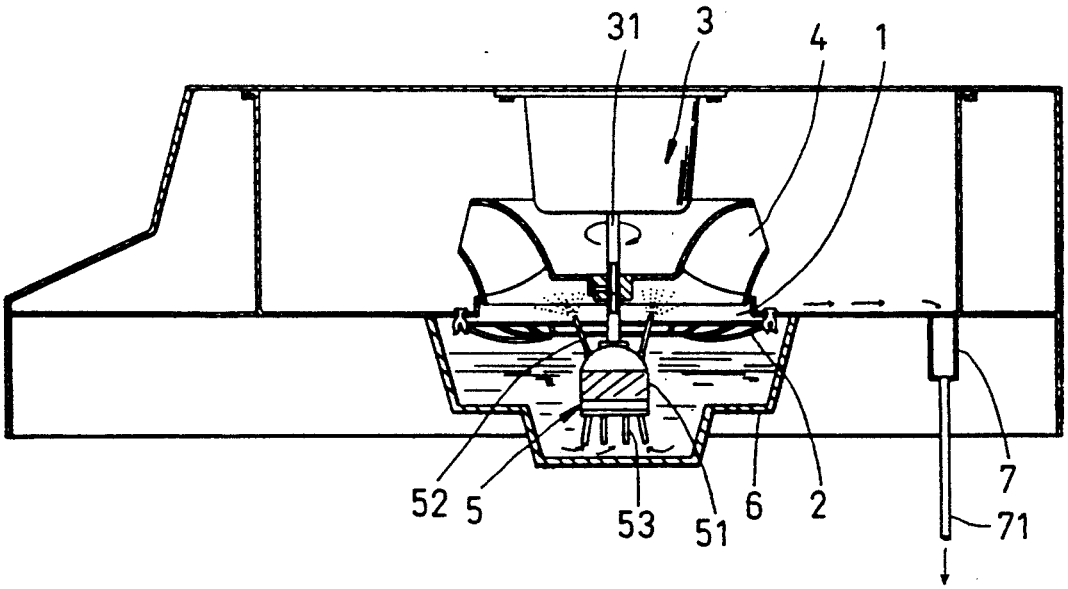
FIG. 4 is the operation diagram for the auto-cleaning device.

Refer to FIG. 4 for operation diagram. The detergent will be put into detergent basin 6 while the basin 6 is detached. After the basin 6 is installed on the smoke-exhausting machine, the detergent will be drawed through the detergent supplying tube 53 into inside of the cylindrical body 51. While the motor 3 is activated, it will drive the spiral body 55 to rotate and then the detergent will be pushed outwards through detergent spraying tube 52 to spray toward the blower 4. The detergent will clean the soot automatically, effectively, and thoroughly via high speed rotation of the blower 4, then it will be drained out through oil filter 7 and draining pipe 71 without outside environment contamination.

With this invention thus explained, it is apparent that numerous modifications and variations can be made without departing from the scope and spirit of this invention. It is therefore intended that this invention be limited only as indicated in the appended claims.

I claim:

1. An automatic cleaning device of a smoke exhauster having an air inlet comprising:

a motor having a vertical spindle;

a fluid emitting pump provided with a revolving rod having the upper end fastened with the lower end of said spindle of said motor; and a cleaning fluid reservoir mounted detachably under the air inlet of the smoke exhauster;

said fluid emitting pump is provided at a midsection thereof with a pump body of hollow columnar construction and having a top wall, a bottom wall and an interior located between said top wall and said bottom wall, with said top wall being provided with a plurality of fluid emitting tubes communicating with said interior of said pump body, and with said bottom wall being provided with a plurality of fluid admitting tubes in communication with said interior of said pump body; and a spiral body fastened to said revolving rod of said fluid emitting pump, said spiral body being provided with a plurality of propelling slant members located within said pump body.

2. The automatic cleaning device of claim 1 wherein said cleaning fluid reservoir is of basinlike construction and provided with a bottom having a U-shaped depression in which said fluid admitting tubes of said bottom wall are located.

* * * * *